United States Patent [19]

Horn et al.

[11] Patent Number: 4,772,238

[45] Date of Patent: Sep. 20, 1988

[54] FOIL MASK STRETCHING APPARATUS AND PROCESS

[75] Inventors: Karl H. Horn, Park Ridge; Paul Strauss, Chicago, both of Ill.

[73] Assignee: Zenith Electronics Corporation, Glenview, Ill.

[21] Appl. No.: 139,568

[22] Filed: Dec. 30, 1987

[51] Int. Cl.[4] ..... H01J 9/236

[52] U.S. Cl. ..... 445/30; 29/447; 29/448; 445/66

[58] Field of Search ..... 445/30, 37, 68, 66; 140/108, 109; 160/371; 29/447, 448

[56] References Cited

U.S. PATENT DOCUMENTS

| | | | |
|---|---|---|---|
| 2,625,734 | 1/1953 | Law | 445/52 |
| 2,654,940 | 10/1953 | Law | 29/447 X |
| 3,357,459 | 12/1967 | Cohen et al. | 140/109 X |
| 3,894,321 | 8/1975 | Moore | 445/30 X |
| 4,069,567 | 1/1978 | Schwartz | 445/30 |
| 4,591,344 | 5/1986 | Palae | 445/30 |

OTHER PUBLICATIONS

"The CBS-Colortron: A Color Tube of Advanced Design," Fyler et al., Proceedings of the IRE, Dec. Class, R583.6, Jan. 1954, pp. 326-334.

*Primary Examiner*—Kenneth J. Ramsey

[57] ABSTRACT

An apparatus and a process is disclosed for use in the manufacture of a color cathode ray tube having a tensed foil shadow mask with a central apertured area and an unapertured border. The apparatus, which provides for thermally expanding an in-process shadow mask, includes a pair of heated platens for embracing a mask. At least one of the platens has a recess therein with width and length dimensions no less than the apertured area such that migrant particles trapped between the platens cannot damage the apertured area.

14 Claims, 4 Drawing Sheets

FOIL MASK STRETCHING APPARATUS AND PROCESS

CROSS-REFERENCE TO RELATED APPLICATIONS AND PATENTS

This application is related to but in no way dependent upon copending applications Ser. No. 051,896 filed May 18, 1987; Ser. No. 058,095 filed June 4, 1987; Ser. No. 060,135 filed June 9, 1987; and U.S. Pat. Nos. 3,894,321; 4,069,567; 4,547,696; 4,591,344; 4,593,224; 4,593,225; 4,595,857; 4,614,892; 4,652,791; 4,656,388; 4,672,260; 4,678,447; 4,686,416; 4,692,660; 4,695,761; and 4,701,678, all of common ownership herewith.

BACKGROUND OF THE INVENTION

1. Field of the Invention

This invention relates to color cathode ray picture tubes having a foil tension mask, and is addressed specifically to an improved apparatus and process for manufacturing the shadow mask component.

The use of the tension foil mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high-brightness where the intensity of the electron beam bombardment is greatest. Color impurities result as the mask moves closer to the faceplate. Although it is under high tension, the tensioned foil mask will dome, but negligibly so in comparison with the curved mask. Its relative immunity to doming provides for greater brightness potential while maintaining color purity.

The tensioned foil shadow mask is a part of the cathode ray tube front assembly, and is located in close adjacency to the faceplate. The front assembly comprises the faceplate with its screen consisting of deposits of light-emitting phosphors, a shadow mask, and support means for the mask. As used herein, the term "shadow mask" means an apertured metallic foil which may, by way of example, be about one mil thick, or less. The mask must be supported in high tension a predetermined distance from the inner surface of the cathode ray tube faceplate; this distance is known as the "Q-distance." As is well known in the art, the shadow mask acts as a color-selection electrode, or parallax barrier, which ensures that each of the three electron beams generated by the electron gun lands only on its assigned phosphor deposits.

2. Prior Art

U.S. Pat. No. 3,894,321 to Moore, of common ownership herewith, is directed to a method for processing a color cathode ray tube having a thin foil mask sealed directly to the bulb. Included in this disclosure is a description of the sealing of a foil mask between the junction of the skirt of the faceplate and the funnel. The foil mask is noted as having a greater thermal coefficient of expansion than the glass to which it is mounted, hence following a heating and cooling cycle in which the mask is cemented at the funnel-faceplate junction, the greater shrinkage of the mask upon cooling places it under tension. The mask is shown as having two or more alignment holes near the corners which mate with alignment nipples in the faceplate. The nipples pass through the alignment holes to fit into recesses in the funnel.

There have been a number of disclosures of tensed foil masks and means for applying tension to the mask and maintaining it in tension. Typical of these is the disclosure of Law in U.S. Pat. No. 2,625,734, which addresses the construction of a taut, planar, foraminous mask, and the mounting of the mask and target (the screen on the faceplate) as a unitary assembly within the envelope. The thin metal is clamped in a frame, and the mask is heated and placed under screw tension. Upon cooling, the metal contracts and the mask is thus rendered taut and held in tension by the frame.

In U.S. Pat. No. 4,069,567 to Schwartz, assigned to the assignee of the present invention, there is disclosed a method useful in the manufacture of a color cathode ray tube of the type with a phosphor screen, and having spaced therefrom a tensed color selection electrode. In a preferred execution, the method comprises selecting for the electrode a material which has a significantly greater coefficient of thermal expansion than that of the holder. The electrode and the holder are externally heated together, as by an oven, while the electrode is tensed. Simultaneously therewith, a selective auxiliary heating of the electrode is induced, as by passing an electrical current through the electrode, or by RF heating, such that the electrode is heated to a predetermined elevated temperature signifi-cantly greater than that of the holder so that the electrode is caused to thermally expand a greater amount than the holder. The electrode is then affixed to the holder. Finally, the electrode and holder are cooled to room temperature so as to hypertense the electrode due to greater coefficient of thermal expansion of the material from which it is made.

A thin, perforated diaphragm used as a shadow mask was used in an early color picture tube called a "Colortron." The mask, which is round, is used as an optical stencil for use in photographically depositing color phosphors on an associated screen. The mask, when mounted on a frame, is said to be lightweight and self-supporting, and the use of the frame facilitates insertion and removal during the photoscreening process. ("The CBS Colortron: A Color Picture Tube of Advanced Design". Fyler et al. IRE R583.6. January 1954.)

OBJECTS OF THE INVENTION

It is a general object of this invention to provide an apparatus and a process for facilitating the manufacture of color cathode ray tubes having a tensed foil shadow mask.

It is an object of this invention to provide an improved fixturing apparatus capable of facilitating the manufacture of color cathode ray tubes having a tensed foil shadow mask.

It is another object of this invention to provide improved fixturing means for use in the manufacture of an inprocess faceplate assembly comprising a tensed foil shadow mask and faceplate.

It is a further object of this invention to provide apparatus and process for ensuring uniform tension of foil shadow masks.

It is an object of the invention to eliminate damage to foil shadow masks that may be incurred during manufacture.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (noted as being not to scale) in the several figures of which like reference numerals identify like elements, and in which:

DESCRIPTION OF THE PREFERRED EMBODIMENT

To facilitate understanding of the invention and its relation to the manufacture of a tensed foil mask cathode ray tube, a brief description of a tube of this type and its components is offered in following paragraphs.

Figure 1:
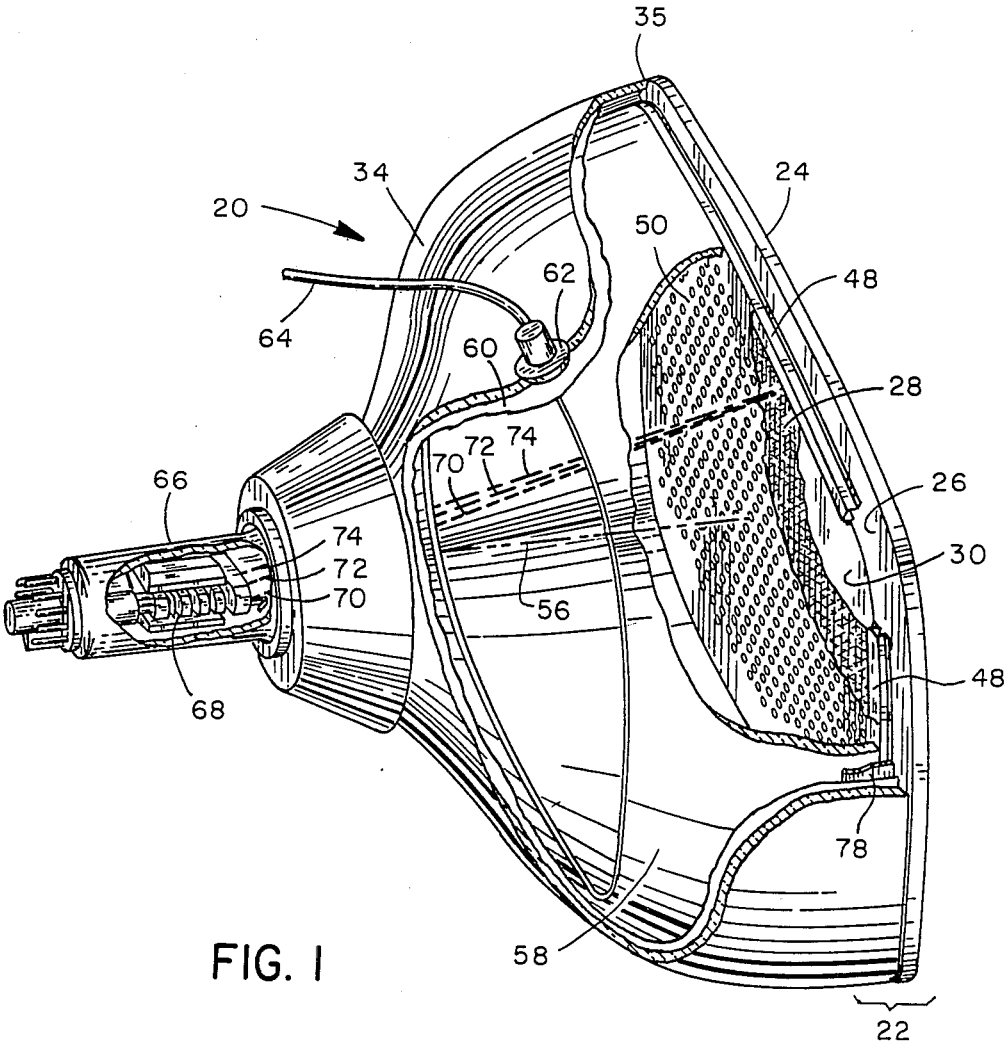
FIG. 1 is a side view in perspective of a color cathode ray tube having a flat faceplate and a tensed foil shadow mask, with cut-away sections that indicate the location and relation of the shadow mask to other major tube components.

A color cathode ray tube 20 having a tensed foil shadow mask is depicted in FIG. 1. The faceplate assembly 22 of tube 20 includes a flat glass faceplate 24 having on its inner surface 26 a centrally disposed phosphor screen 28 with a predetermined pattern of phosphor deposits thereon. A film of aluminum 30 is indicated as covering the screen 28. A funnel 34 is represented as being attached to faceplate assembly 22 at their interfaces 35. A shadow mask support structure 48 provides for mounting a metal foil shadow mask 50 which has a pattern of apertures corresponding to the pattern of the phosphor deposits on screen 28. A shadow mask support structure 48 is indicated as being located on opposed sides of the screening area for supporting mask 50 in tension.

The anterior-posterior axis of tube 20 is indicated by reference number 56. A magnetic shield 58 is shown as being enclosed within funnel 34. High voltage for tube operation is indicated as being applied to a conductive coating 60 on the inner surface of funnel 34 by way of an anode button 62 connected in turn to a high-voltage conductor 64.

The neck 66 of tube 20 is represented as enclosing an in-line electron gun 68 depicted as providing three discrete in-line electron beams 70, 72 and 74 for exciting respective red-light-emitting, green-light-emitting, and blue-light-emitting phosphor elements on screen 28. Yoke 76 receives scanning signals and provides for the scanning of beams 70, 72 and 74 across screen 28. A metal contact spring 78 provides an electrical path between the funnel coating 60 and mask support structure 48.

A component termed a "factory fixture frame" is described in some length in the following to facilitate understanding of the present invention. The factory fixture frame is represented as having a number of six-point indexing means that provide for high precision in the registration and reregistration of an in-process shadow mask with a faceplate, and registration with production machinery during manufacture. The factory fixture frame, noted as being reusable, is fully described and claimed in referent copending application Ser. No. 051,896 of common ownership herewith.

Figure 2:
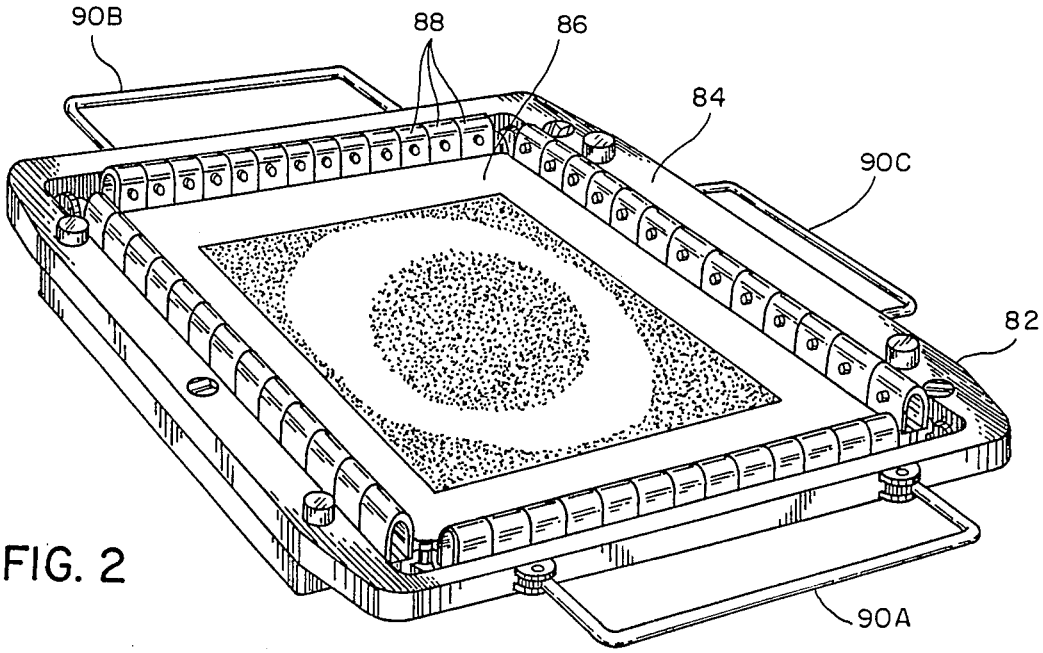
FIG. 2 is an oblique view in perspective of a factory fixture frame according to the invention disclosed in referent copending application Ser. No. 051,896 of common ownership herewith, and which may be utilized in the manufacture of a tension mask cathode ray tube according to the means and process of the present invention; an in-process foil shadow mask is depicted as being mounted in tension in the frame.

A factory fixture frame 82 according to the '896 disclosure is depicted in FIG. 2; a first side 84 of frame 82 is indicated. The frame 82 is intended for use in the manufacture of a color cathode ray tube of the type shown by FIG. 1. As depicted in FIG. 2, factory fixture frame 82 comprises a generally rectangular frame means and quick-release mechanical mask-retaining means for temporarily and removably supporting an in-process shadow mask 86 in tension by means of mechanical mask-retaining means, shown as being in the form of a series of discrete spring clip means 88. The spring clip means of mask tensing and clamping is described and claimed in referent copending application Ser. No. (5506) of common ownership herewith. Essentially, the factory fixture frame 82 provides for mounting and holding an in-process shadow mask in tension for use in photoscreening, and locating the tensed mask in proximate relationship to a mask support structure in preparation for the attachment of the mask to the support structure.

Factory fixture frame 82 will be noted as having handles 90A, 90B and 90C for convenience in handling during manufacture. Handles 90A and 90B provide for lifting the frame, and handle 90C provides for manually inserting and removing the factory fixture frame 82 from production machinery such as a mask tensing-clamping machine.

Figure 3:
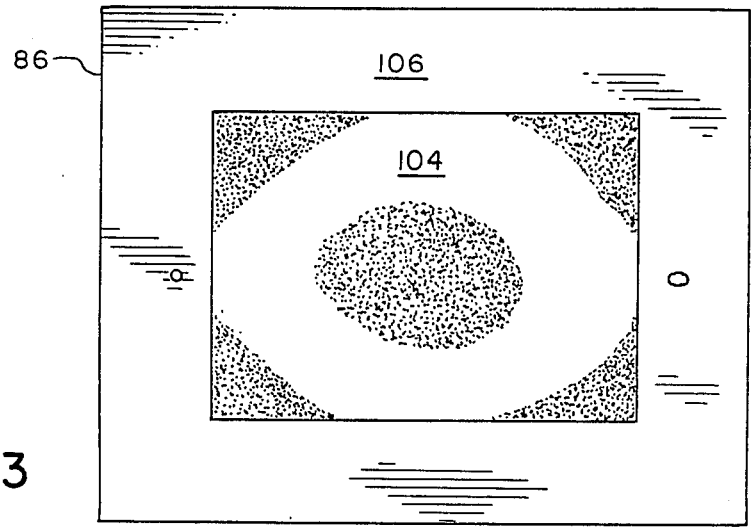
FIG. 3 is a plan view of an in-process foil shadow mask that can be thermally expanded by the apparatus and process of the present invention.

An in-process shadow mask is indicated in FIG. 3 prior to its installation in the factory fixture frame 82. In-process shadow mask 86 includes a central apertured area 104 having a pattern of apertures which correspond to the pattern of phosphor deposits to be photoscreened on the screening area of the faceplate. Central apertured area 104 is indicated as being surrounded by an unapertured boarder 106, the periphery of which is engaged during the mask tensing and clamping process. Mask border 106 is trimmed off in an ensuing manufacturing operation.

Figure 4:
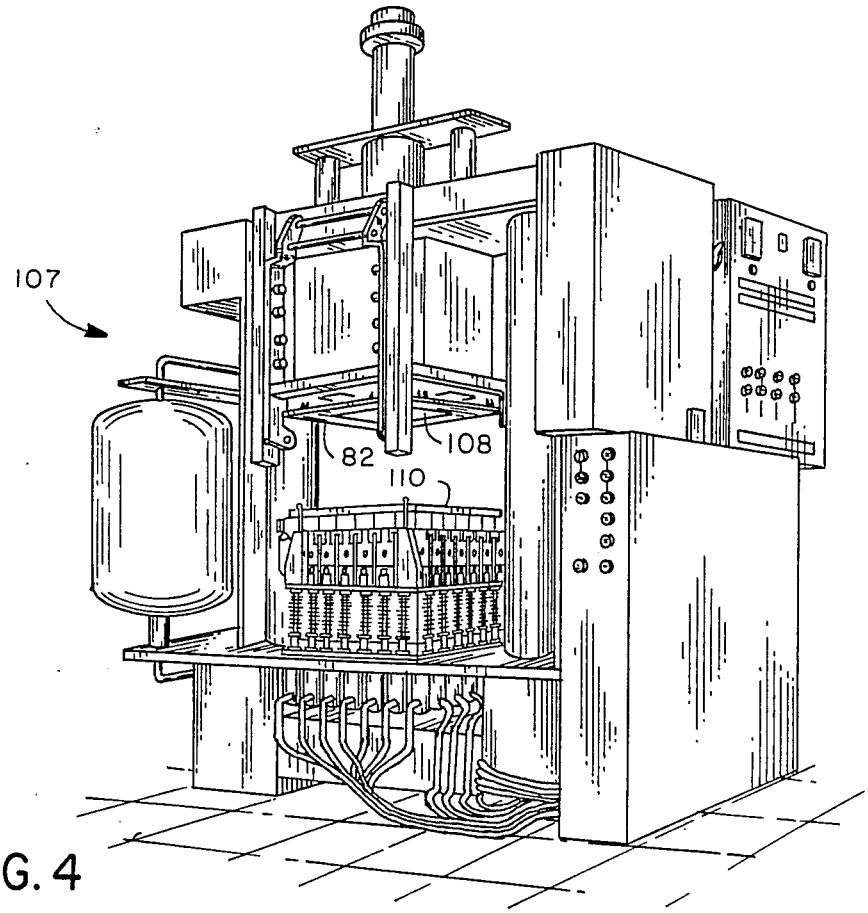
FIG. 4 is a view in elevation and in perspective of a foil mask tensing and clamping machine for receiving the factory fixture frame of FIG. 2; this machine and its function is described in referent copending application Ser. No. 051,896 of common ownership.

The mask tensing-clamping machine 107 depicted in FIG. 4 provides for receiving the factory fixture frame 82, which is loaded into machine 107 by hand by an operator, using the handles described. The factory fixture frame 82 is depicted as being mounted in machine 107 in preparation for receiving and clamping an in-process shadow mask. Machine 107 is indicated as having an upper platen 108 and a lower platen 110 for embracing an in-process mask and uniformly heating and expanding the in-process mask.

Figure 5:
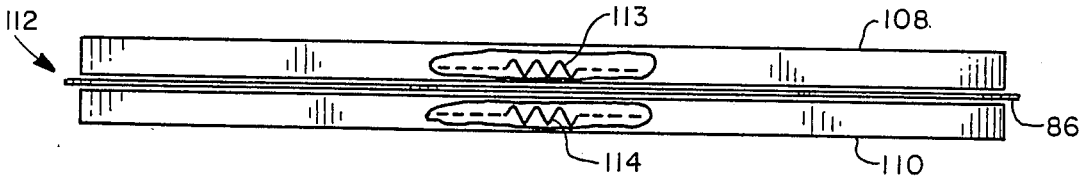
FIG. 5 is view in elevation of platen means according to the invention for expanding an in-process shadow mask; means for thermally expanding the mask by electrically resistive elements are indicated symbolically in the insets.
Figure 6:
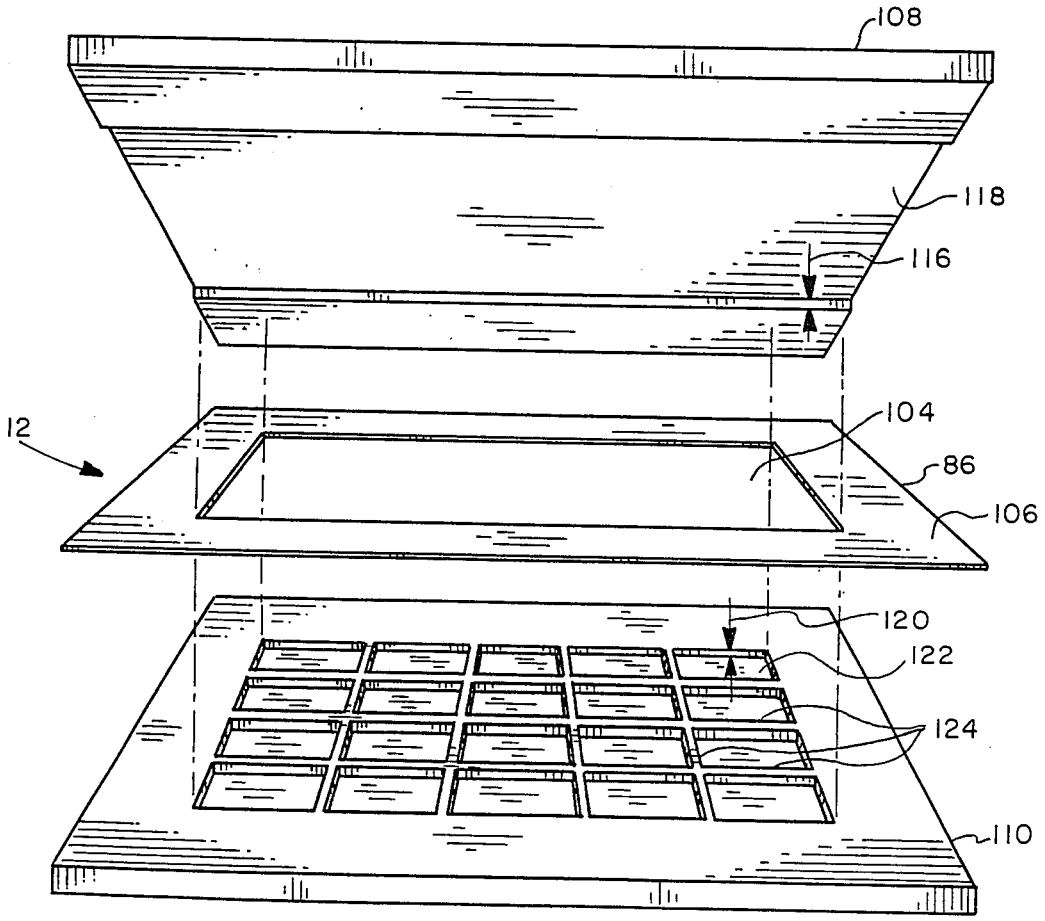
FIG. 6 is an exploded view in elevation and in perspective depicting an upper platen and a lower platen according to the invention, with an in-process shadow mask embraced therebetween.

An apparatus according to the invention for thermally expanding an in-process shadow mask is indicated schematically in FIGS. 5 and 6. The apparatus 112 essentially comprises the pair of heated platens 108 and 110 indicated in FIG. 4 as being mounted in machine 107. The relationship of platens 108 and 110 to an in-process shadow mask 86 during the thermal expansion process is indicated schematically in FIG. 5. Platens 108 and 110 are heated to provide for expansion of the in-process mask prior to its clamping, as indicated schematically by the presence of electrical heating resistive elements 113 and 114. By way of example, the upper platen 108 may be heated to a temperature of about 455 degrees F. and lower platen 110 to a temperature of about 430 degrees F. Factory fixture frame 82, depicted in FIG. 2 as having clamping means 88, provides for clamping the mask boarder 106 and restraining the thermally expanded shadow mask from constricting during subsequent cooling, thus creating tension in the in-process shadow mask. Factory fixture frame 82, while securing in-process mask 86, is removed from the mask tensing-clamping machine 107 in readiness for the subsequent manufacturing operations described in referent copending application Ser. No. 051,896.

With reference to FIG. 6, there is shown the pair of heated platens 108 and 110 in position for embracing in-process mask 86. At least one of the platens has a recess therein with width and length dimensions no less than the apertured area 104 of in-process mask 86 such that migrant particles trapped between the platen and the apertured area are accommodated by the recess and cannot damage the apertured area 104 of the in-process shadow mask 86. The depth of the recess according to the invention is a depth great enough to prevent damage from migrant particles trapped between the platen and the apertured area, but not so great as to inhibit uniform heating of the in-process mask 86. The depth 116 of the recess 118 indicated in upper platen 108 may be in the range of 5 mils to 20 mils, and preferably a depth of about 15 mils.

Upper platen 108 will be noted as having a recess 118 whose length is greater than the length of the apertured area 104; this extended length has been found to be beneficial in providing for a more uniform expansion of the mask 86.

The planarity of the foil mask is maintained according to the invention during the mask expansion operation, as the very thin foil that comprises the mask, which may have a thickness on the order of one-half mil, may "sag" into the recess, and form the equivalent of a catenary curve. As a result, when the mask is thermally expanded and held in tension by the clamping of the unapertured border 106, the sag may persist, resulting in a mask having uneven tension.

Figure 6A:
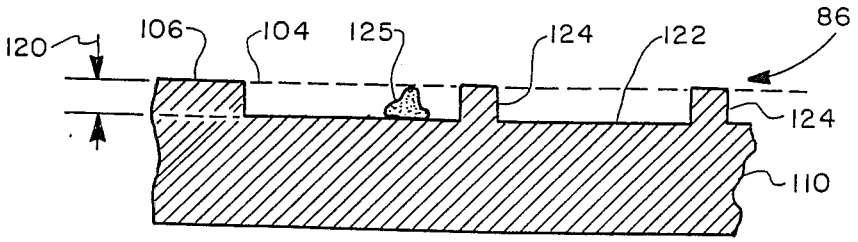
FIG. 6A is a view in elevation and in section of a part of the mask-contacting face of the lower platen of FIG. 6, depicting in greater detail a shadow-mask-supporting structure according to the invention.

With reference also to FIG. 6A, lower platen 110 is depicted as having means according to the invention within its recess 122 for supporting the in-process mask 86 and maintaining the planarity of the in-process mask during its expanding. The means are depicted as comprising a matrix of lands 124 having a height equal to the depth 120 of recess 122. As with upper platen 110, the depth 120 of the recess 122 in lower platen 110, may be in the range of 5 mils to 20 mils, and preferably about 15 mils. The matrix may comprise a series of "cells" as shown, each comprising a square with width and depth dimensions of about two and five-eights of an inch, by way of example. The lands of the cells may have a width of about 0.100 inch, also by way of example. A migrant particle 125 is indicated as being held harmless in the recess 122.

Figure 7:
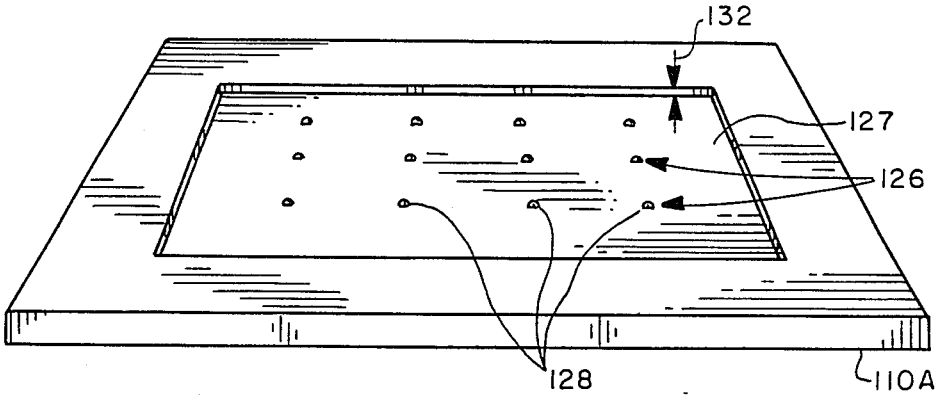
FIG. 7 is a perspective view of another configuration of a shadow-mask-supporting structure embodied in a lower platen.
Figure 7A:
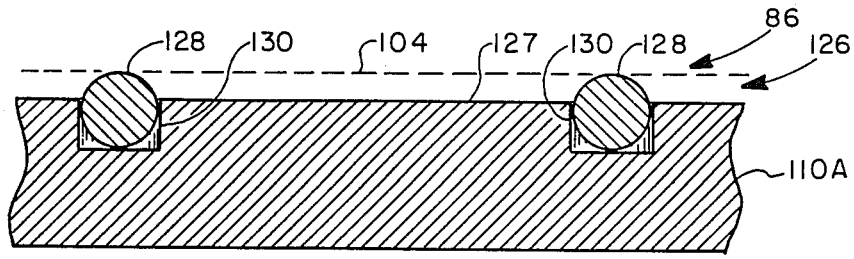
FIG. 7A is a view in elevation and in section of a part of the mask-contacting face of the platen shown by FIG. 7, depicting in greater detail the shadow-mask-supporting structure according to the invention.

Alternately, and according to the invention (and with reference to FIGS. 7 and 7A), the support means for maintaining the planarity of the mask 86 may comprise a plurality of spaced pedestals 126 located in a recess 127 in a lower platen 110A; the pedestals 126 are indicated as comprising ball means 128. The ball means 128 may comprise readily available steel spheres pressed, as indicated, into holes 130 machined in the platen. The degree of press is only that required to accomodate the relative expansion of the platen material, noted as being cast aluminum, to that of the steel spheres over the range of the heating temperature. The depth 132 of recess 127 may be, according to the invention, in the range of 5 to 20 mils, and preferably about 15 mils.

With regard to the need for a recess in at least one of the platens to prevent damage from migrant particles that may become trapped between a platen and the central apertured area of the mask, it is considered impractical to maintain a clean room environment completely devoid of migrant particles in the presence of a mechanism such as the mask tensing and clamping machine 107 shown in FIG. 4. A massive electro-pneumatic device of this type could shed particles during its operation, and since the in-process mask is located in the center of the machine, particles could fall on, or beneath, the central apertured area of the in-process mask. Another potential source of contamination comprises particulates shed by the clothing of the operators, such as strands of smock material. Any such material that can melt on the platens can actually produce repetitive plugging of the apertures in the central apertured area 104. Even very few of such particles caught between the platens can dent a mask and/or plug a mask aperture and make the mask a reject.

A process according to the invention for expanding an inprocess foil shadow mask and retaining the mask in an expanded state for installation in a color cathode ray tube comprises the following:

forming the in-process mask so as to have a central apertured area and an unapertured border;

embracing the in-process mask with an upper platen and a lower platen for uniformly heating and thermally expanding the in-process mask;

providing a recess in each of the platens whose width and length dimensions are no less than the central apertured area;

preventing the mask from sagging into the recess in the lower platen by providing support means comprising a matrix of lands having a height equal to the depth of the recess effective to maintain the planarity of the mask during the expanding of the mask;

retaining the in-process mask in an expanded state by clamping the border;

such that migrant particles trapped between the platens and the central apertured area are accommodated by the recesses, and the particles cannot damage the central apertured area.

The process according to the invention may further include the providing of means for supporting the in-process mask so that it does not sag into the recess in the lower platen. Mask planarity may be maintained according to the invention either by providing a matrix of lands in the recess in the lower platen, or by a plurality of spaced pedestals in the recess.

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

What is claimed is:

1. For use in the manufacture of a color cathode ray tube having a tensed foil shadow mask with a central apertured area and an unapertured border, an apparatus for thermally expanding an in-process shadow mask including a pair of heated platens for embracing a mask, at least one of said platens having a recess therein with width and length dimensions no less than said apertured area such that migrant particles trapped between said platens cannot damage said apertured area.

2. The apparatus according to claim 1 wherein said recess has a depth great enough to prevent damage from migrant particles trapped between said platen and said area, but not so great as to inhibit uniform heating of said in-process mask.

3. The apparatus according to claim 2 wherein said recess has a depth in the range from 5 mils to 20 mils.

4. The apparatus according to claim 3 wherein said recess has a depth of about 15 mils.

5. For use in the manufacture of a color cathode ray tube having a tensed foil shadow mask, an apparatus for thermally expanding an in-process shadow mask having a central apertured area and an unapertured border, said apparatus including an upper platen and a lower platen for embracing said in-process mask and uniformly heating and expanding said mask, and clamping means for clamping said border and retaining said in-process mask in an expanded state, each of said platens having a recess therein with width and length dimensions no less than said apertured area such that migrant particles trapped between said platens and said apertured area are accommodated by the recesses and cannot damage said apertured area, said lower platen having means within its recess for supporting said in-process mask and maintaining the planarity of said in-process mask during said expanding.

6. The apparatus according to claim 5 wherein said means for maintaining the planarity of said mask comprises a matrix of lands having a height equal to the depth of said recess.

7. The apparatus according to claim 5 wherein said means in said lower platen for maintaining the planarity of said mask comprises a plurality of spaced pedestals each having a height substantially equal to the depth of said recess.

8. The apparatus according to claim 7 wherein said plurality of spaced pedestals comprises ball means pressed into holes in said lower platen.

9. For use in the manufacture of a color cathode ray tube having a tensed foil shadow mask, an apparatus for thermally expanding an in-process shadow mask having a central apertured area and an unapertured border, said apparatus including an upper platen and a lower platen for embracing said in-process mask and uniformly heating and expanding said in-process mask, and clamping means for clamping said border and retaining said in-process mask in an expanded state, each of said platens having a recess therein with width and length dimensions no less than said apertured area such that migrant particles trapped between said platens and said apertured area are accommodated by the recesses and cannot damage said area, said lower platen having mask-supporting means in its recess comprising a matrix of lands having a height equal to the depth of said recess for supporting said in-process mask and maintaining the planarity of said in-process mask during said expanding.

10. For use in the manufacture of a color cathode ray tube having a tensed foil shadow mask, an apparatus for thermally expanding an in-process shadow mask having a central apertured area and an unapertured border, said apparatus including an upper platen and a lower platen for embracing said in-process mask and uniformly heating and expanding said in-process mask, and clamping means for clamping said border and retaining said in-process mask in an expanded state, each of said platens having a recess therein with width and length dimensions no less than said apertured area such that migrant particles trapped between said platens and said apertured area are accommodated by the recesses and cannot damage said area, said lower platen having mask-supporting means in its recess comprising a plurality of spaced pedestals each having a height substantially equal to the depth of said recess for supporting said in-process mask and maintaining the planarity of said in-process mask during said expanding.

11. The apparatus according to claim 10 wherein said plurality of spaced pedestals comprises ball means pressed into holes in said lower platen.

12. For use in the manufacture of a color cathode ray tube having a tensed foil shadow mask, a process for expanding an in-process foil shadow mask and retaining said in-process mask in an expanded state for installation in said tube, comprising:

forming said in-process shadow mask to provide a central apertured area and an unapertured border;

embracing said in-process mask with heated platens for uniformly heating and thermally expanding said in-process mask;

providing a recess in at least one of said platens whose width and length dimensions are no less than said central apertured area;

such that migrant particles trapped between said platens and said central apertured area are accommodated by said recess, and said particles cannot damage said central apertured area.

13. For use in the manufacture of a color cathode ray tube having a tensed foil shadow mask, a process for expanding an in-process mask and retaining said in-process mask in an expanded state for installation in said tube, comprising:

forming said in-process mask so as to have a central apertured area and an unapertured border;

embracing said in-process mask with an upper platen and a lower platen for uniformly heating and thermally expanding said in-process mask;

forming a recess in each of said platens whose width and length dimensions are no less than said central apertured area;

providing a matrix of lands in said recess in said lower platen having a height equal to the depth of said recess;

retaining said in-process mask in an expanded state by clamping said border;

such that migrant particles trapped between said platens and said central apertured area are accommodated by the recesses and said particles cannot damage said central apertured area, and said mask is prevented from sagging into said recess in said lower platen.

14. For use in the manufacture of a color cathode ray tube having a tensed foil shadow mask, a process for expanding an inprocess mask and retaining said in-process mask in an expanded state for installation in said tube, comprising:

forming said in-process mask so as to have a central apertured area and an unapertured border;

embracing said in-process mask with an upper platen and a lower platen for uniformly heating and thermally expanding said in-process mask;

forming a recess of about 15 mils in depth in each of said platens whose width and length dimensions are no less than said central apertured area;

providing a plurality of spaced pedestals in said recess in said lower platen for supporting said in-process mask;

retaining said in-process mask in an expanded state by clamping said border;

such that migrant particles trapped between said platens and said central apertured area are accommodated by the recesses and said particles cannot damage said central apertured area, and said mask is prevented from sagging into said recess in said lower platen by said pedestals.

* * * * *